US010927523B2

(12) United States Patent
Albers et al.

(10) Patent No.: US 10,927,523 B2
(45) Date of Patent: Feb. 23, 2021

(54) CROSS-MEMBERS AND PIN COUPLERS FOR LIFT ARMS

(71) Applicant: Caterpillar Inc., Deerfield, IL (US)

(72) Inventors: Riley A. Albers, Sugar Grove, IL (US); Steven D. Springer, Naperville, IL (US); Rowan T. Franks, Penguin (AU); David R. Evans, Oswego, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/279,670

(22) Filed: Feb. 19, 2019

(65) Prior Publication Data

US 2020/0263386 A1 Aug. 20, 2020

(51) Int. Cl.

| | |
|---|---|
| ***E02F 3/627*** | (2006.01) |
| ***E02F 3/38*** | (2006.01) |
| ***E02F 3/36*** | (2006.01) |

(52) U.S. Cl.

CPC ..... *E02F 3/627* (2013.01); *E02F 3/3604* (2013.01); *E02F 3/382* (2013.01)

(58) Field of Classification Search

CPC ..... E02F 3/3411

USPC ..... 414/727

See application file for complete search history.

(56) References Cited

U.S. PATENT DOCUMENTS

| | | | | |
|---|---|---|---|---|
| 4,162,872 | A * | 7/1979 | Grooss | E02F 9/006 414/713 |
| 5,732,781 | A | 3/1998 | Chambers | |
| 5,993,138 | A | 11/1999 | Anderson et al. | |
| 9,469,973 | B2 | 10/2016 | Imaizumi et al. | |
| 10,156,053 | B2 * | 12/2018 | Hren | E02F 3/38 |
| 2006/0099081 | A1 | 5/2006 | Toda et al. | |
| 2015/0345103 | A1 | 12/2015 | Daiberl | |
| 2018/0087236 | A1 * | 3/2018 | Marek | E02F 3/40 |

FOREIGN PATENT DOCUMENTS

| | | |
|---|---|---|
| EP | 3159451 | 4/2017 |
| JP | 3775657 | 5/2006 |
| JP | 2013170582 | 9/2013 |

OTHER PUBLICATIONS

"Komatsu: WA-390 Wheel Loader", Retrieved from the Internet: http: www.komatsu.com ce products pdfs WA900-3E0_CEN00187-04.pdf, (2014), 12 pgs.

* cited by examiner

*Primary Examiner* — Ronald P Jarrett

(74) *Attorney, Agent, or Firm* — Hibshman Claim Construction PLLC

(57) ABSTRACT

A lift arm for a loader can comprise a pivot end section extending along a first axis and including a first pin hole defining an origin at the intersection of x- and y-axes, a bucket end section extending along a second axis and including a second pin hole located a first distance away from the origin on the y-axis, and a hump section connecting the pivot and bucket end sections comprising a lifting cylinder coupler section including a third pin hole located a second distance away from the y-axis and a torque tube coupling section.

17 Claims, 11 Drawing Sheets

CROSS-MEMBERS AND PIN COUPLERS FOR LIFT ARMS

TECHNICAL FIELD

The present application relates generally, but not by way of limitation, to lift arms for loaders. More particularly, but not by way of limitation, the present application relates to lift arms having cross members and pin couplings that can be used in underground wheel loaders.

BACKGROUND

Wheel loaders, track loaders, and other loading machines are equipped with buckets for the purposes of digging, loading, and transporting different types materials. An underground loader, also known as a load, haul, dump (LHD) machine, is adapted to perform these functions at underground mining sites, which can present smaller, more confined work spaces than surface-level operations. Despite the varying logistical difficulties presented at different mining sites, common to most is that materials in a loose state such as ore, rock and gravel must be moved around and often among different machines for transport and processing. One typical loader application at mine sites is the loading of blasted rock such as ore or overburden into a truck for disposal or transport to a processing site, or delivery of ore directly to a crusher.

As suggested above, underground access is typically relatively limited, often resulting in narrow passageways, low clearances, and other difficulties. While loaders for surface mining and underground loaders share many features, underground loaders and related equipment are often purpose-built to meet the logistical challenges of underground excavation, typically having heavy planetary axles, four-wheel drive, and articulated steering to maximize maneuverability while having a narrower, longer, and lower profile in order to fit into tight access points. These adaptations extend not only to the body of underground loaders but also to its operational features such as the bucket and lift arms coupling the bucket to the body.

Publication No. US 2015/0345103A1 to Daiberl, entitled "Linkage Assembly For Machine," and Publication No. US 2018/0087236 A1 to Marek et al., entitled "Implement System With Bucket Having Torsional Support, And Machine having Same," disclose lift arms for loaders.

SUMMARY OF THE INVENTION

A lift arm for a loader can comprise a pivot end section extending along a first axis and including a first pin hole defining an origin at the intersection of a horizontal x-axis and a vertical y-axis, a bucket end section extending along a second axis and including a second pin hole located a first distance away from the origin on the y-axis, and a hump section connecting the pivot end section and the bucket end section, wherein the hump section can comprise a lifting cylinder coupler section including a third pin hole located a second distance away from the y-axis that is approximately one-third of the first distance, and a torque tube coupling section.

A lift arm assembly for a loader can comprise a first lift arm, a second lift arm, and a torque tube structure connecting the first lift arm and the second lift arm, wherein the torque tube structure can comprise a first lift arm coupler connected to the first arm and comprising a first pocket for receiving a first lift cylinder coupler, a second lift arm coupler connected to the second arm and comprising a second pocket for receiving a second lift cylinder coupler, and a torque tube extending from the first lift arm coupler to the second lift arm coupler.

DETAILED DESCRIPTION

Figure 1:
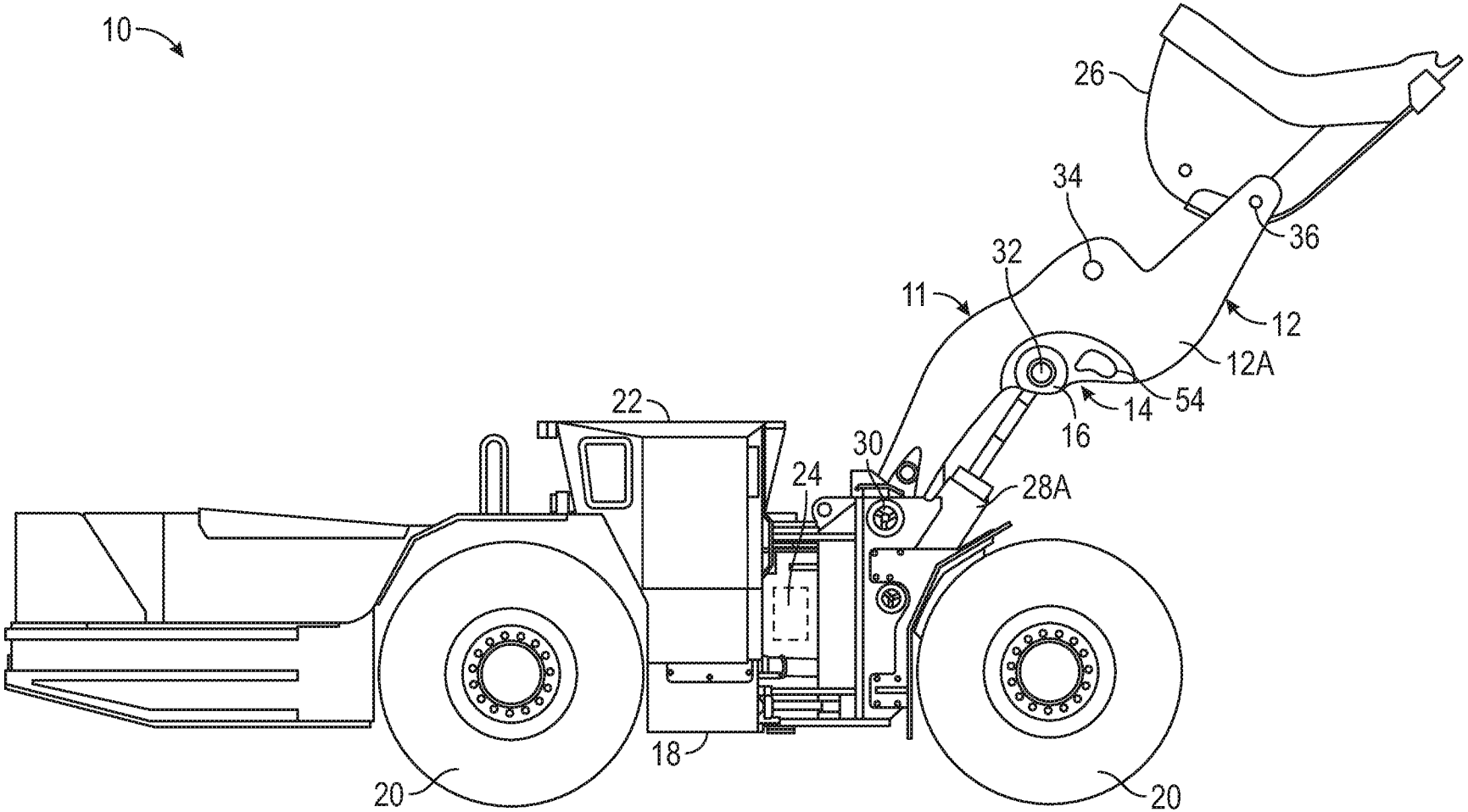
FIG. 1 is a schematic side view of an underground wheel loader that can incorporate lift arms including a cross member having integrated pin couplers of the present disclosure.

FIG. 1 is a schematic side view of underground wheel loader 10 that can incorporate lift arm assembly 11, which can comprise lift arms 12 and cross member 14 having integrated couplers 16 of the present disclosure. Lift arm assembly 11 can include a pair of lift arms, such as right and left lift arms 12A and 12B (FIG. 2), respectively, which can include right and left couplers 16A and 16B, respectively. Loader 10 can comprise frame 18 that can support traction devices 20, cab 22, and power source 24, such as a hydrostatic drive or an internal combustion engine, and the like. Loader 10 can further include bucket 26 and lift cylinders 28, which can include right and left lift cylinders 28A and 28B. Power source 24 can be operatively coupled to traction devices 20, which can comprise wheels, to provide forward and rearward motive force to loader 10, such as via an operator of loader 10 located in cab 22.

Figure 2:
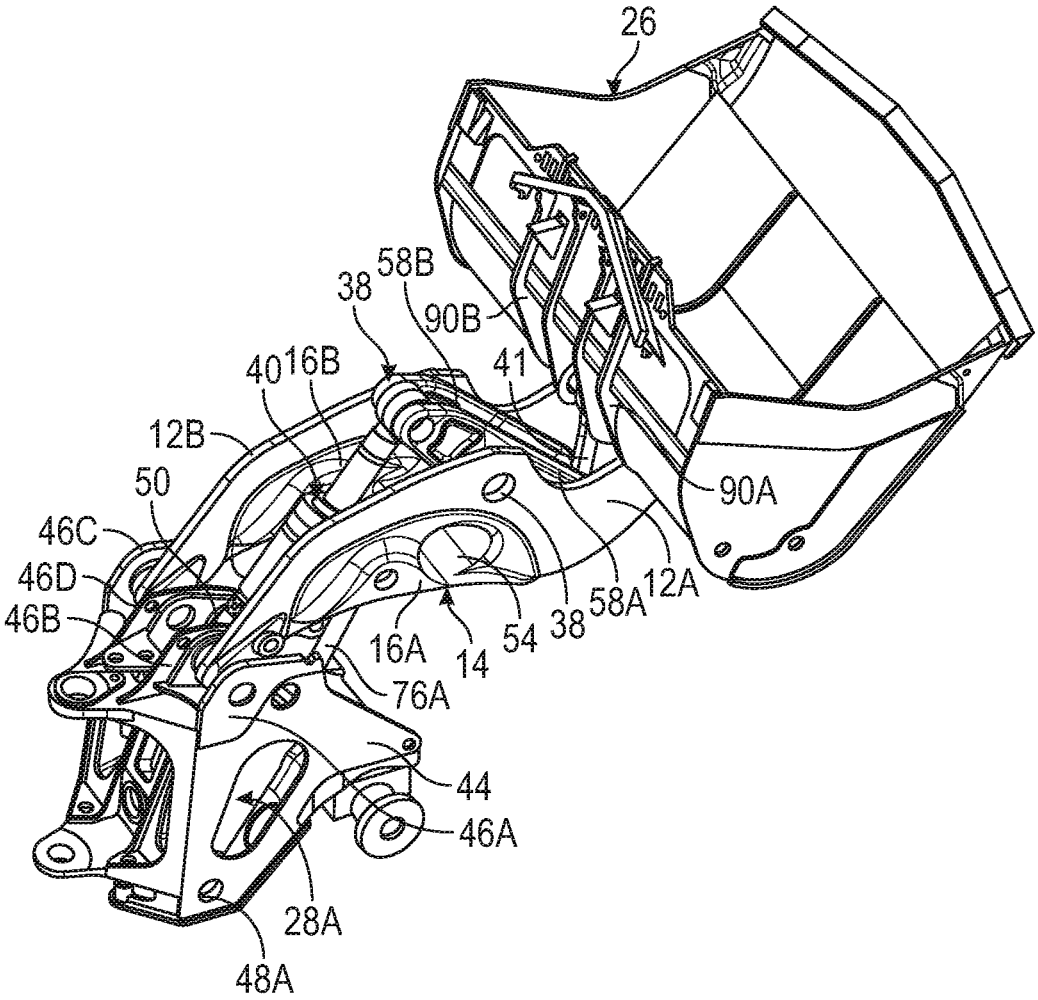
FIG. 2 is perspective view of a lift arm assembly coupled to a bucket and a loader frame member with the lift arm assembly in a raised position relative to the frame member and the bucket in a scoop position.
Figure 3:
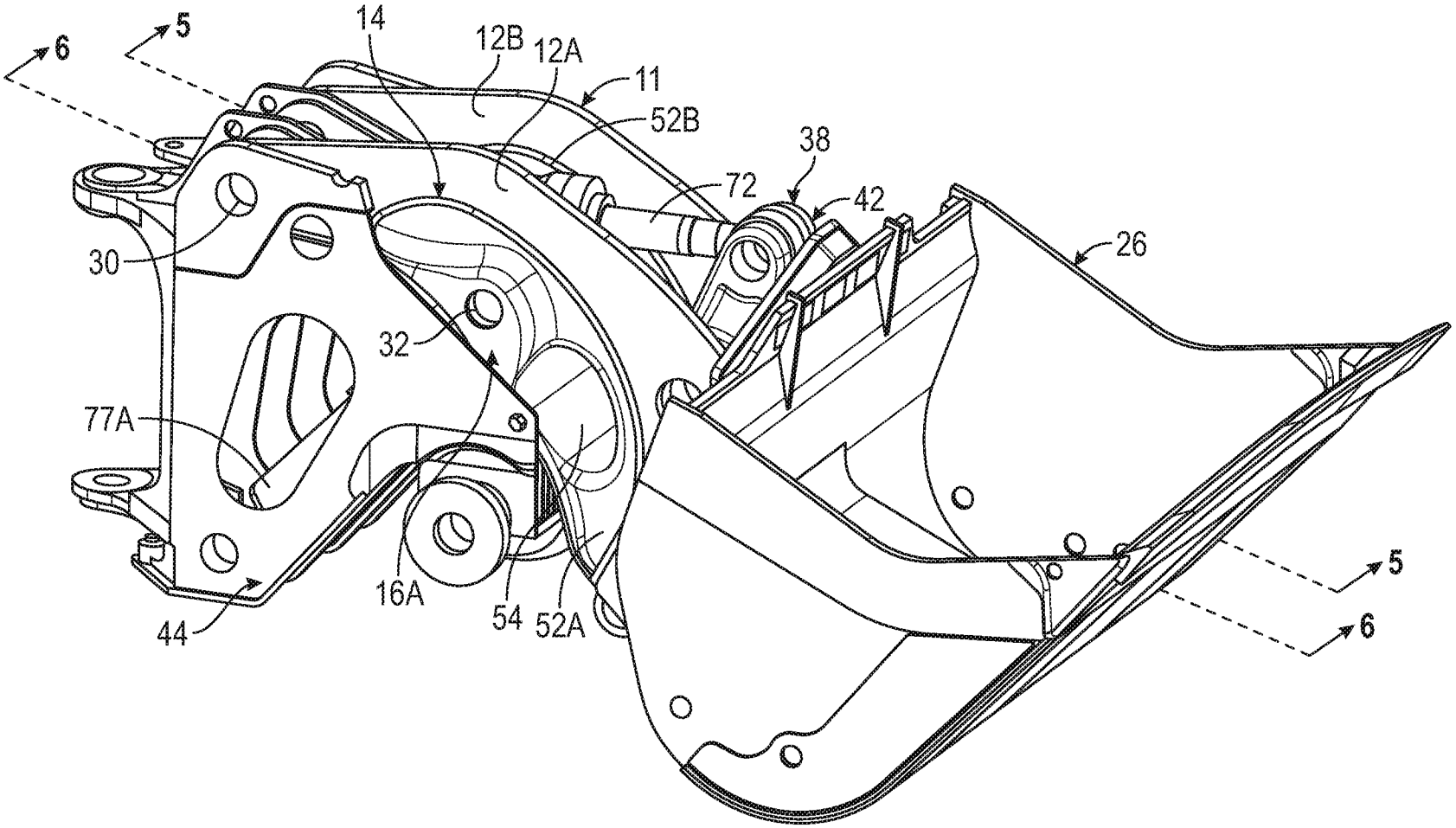
FIG. 3 is a perspective view of the lift arm assembly, bucket and frame member with the lift arm assembly in a lowered position relative to the frame member and the bucket in a haul scoop position.
Figure 4:
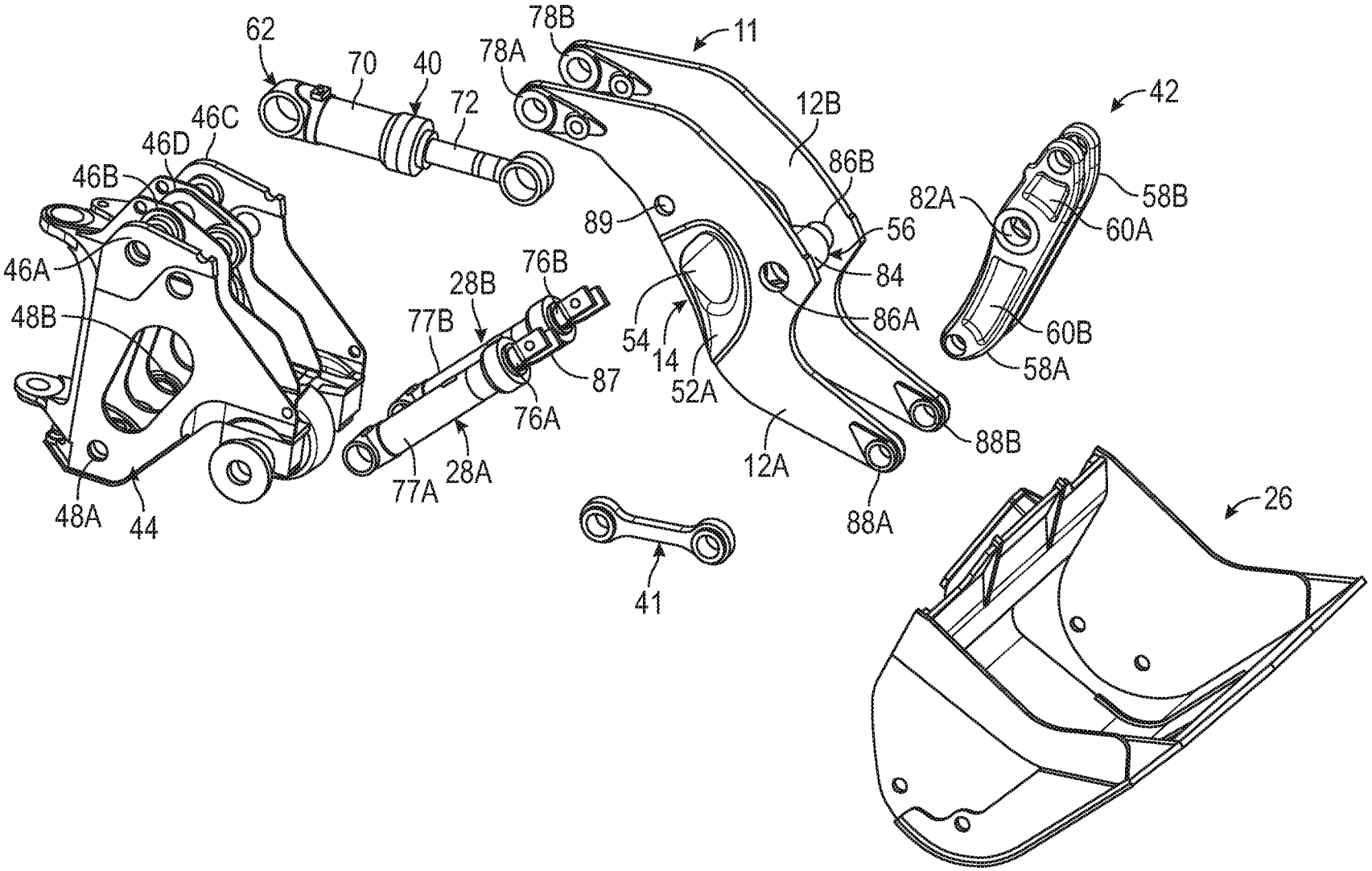
FIG. 4 is an exploded view of the lift arm assembly, bucket and frame member of FIG. 3.

As shown in FIGS. 2-4, loader 10 can include left and right lift arms 12A and 12B, left and right couplers 16A and 16B, and left and right lift cylinders 28A and 28B. Lift arms 12A and 12B can include proximal pivot point 30, lift pivot point 32, tilt pivot point 34, and distal pivot point 36. Lift arms 12A and 12B can be connected to frame 18 at proximal pivot point 30. Lift arms 12A and 12B can be connected to bucket 26 and distal pivot point 36. Lift cylinders 28A and 28B can extend from frame 18 to lift pivot point 32 at couplers 16A and 16B of cross member 14. Lift arms 12A and 12B can be connected to tilt mechanism 38 (FIG. 2) at tilt pivot point 34. Tilt mechanism 38 (FIG. 2) can include tilt cylinder 40, linkage 41, and lever 42.

Lift cylinders 28A and 28B can be extended and retracted to rotate lift arms 12A and 12B at pivot point 32. Specifically, lift cylinders 28A and 28B can be extended to raise lift arms 12A and 12B and can be retracted to lower lift arms 12A and 12B. Tilt cylinder 40 can be actuated to move lever 42 to pivot bucket 26 at pivot point 36, such as for scooping, dumping and hauling operations.

Loader 10 can be configured to perform work associated with a particular industry such as, for example, underground mining, open pit mining, construction etc. For example, loader 10 can be an underground mining loader, as shown in FIG. 1, a load haul dump loader, a wheel loader, a skid steer loader, or any other machine.

In order to facilitate operation of loader 10 in subterranean environments, it can be desirable to reduce the height of lift arms 12A and 12B. However, lift arms 12A and 12B must additionally be strong enough to lift bucket 26 and loads located therein, withstand the torque applied thereto by lift cylinders 28A and 28B, and provide lateral or side-to-side stability, in addition to minimizing obstruction to an operator of loader 10 in cab 22. Lift arms 12A and 12B can be provided with cross member 14 that links left and right lift arms 12A and 12B via torque tube 54 (FIG. 2) and includes pivot point 32 in a location that allows cylinders 28A and 28B to apply sufficient torque at pivot point 30. In various examples, pivot point 32, which can comprise pockets for receiving eyelets of piston rods of lift cylinders 28A and 28B, and torque tube 54 can be integrated into a monolithic component that is manufactured separately from lift arms 12A and 12B, thereby allowing the strength, rigidity and location for various features to be increased to improve the performance of lift arm assembly 11 in a compact design.

FIG. 2 is perspective view of lift arm assembly 11 of FIG. 1 coupled to bucket 26 and loader frame member 44. FIG. 2 shows lift arm assembly 11 in a raised position relative to frame member 44 and bucket 26 extended into a scooping position.

FIG. 3 is a perspective view of lift arm assembly 11, bucket 26 and frame member 44 with lift arm assembly 11 in a lowered position relative to frame member 44 and bucket 26 retracted into a haul position.

FIG. 4 is an exploded view of lift arm assembly 11, bucket 26 and frame member 44 of FIG. 3. FIGS. 2-4 are discussed concurrently. Note, FIG. 4 is modified to include an additional configuration of lift arm assembly 11 in which arm coupler 52A does not include coupler 16A. Coupler 16A can be removed from lift arm 12A and replaced with through-bore 89 that passes through the material of hump section 96A (FIG. 7). Lift arm 12B and arm coupler 52B can additionally be configured in such manner. In such configurations, one or both of eyelets 80A and 80B can be replaced with a clevis, such as clevis 87. For such a configuration, the location of through-bore 89 relative to apertures 91A and 91B is moved; e.g., pivot point 32 can move to a different location as discussed below. In order to accommodate the location of through-bore 89, hump section 96A can include a bulge extending downward relative to the orientation of FIG. 4. The remainder of the description of FIG. 4 is with respect to the embodiment of FIGS. 2, 3 and 5-11.

Frame member 44 can be coupled to frame 18 (FIG. 1) of loader 10 and can include various features for coupling to lift arm assembly 11, such as arm flanges 46A-46D for connecting to proximal ends of lift arms 12A and 12B, cylinder couplers 48A and 48B for connecting to lift cylinders 28A and 28B, and cylinder coupler 50, which can be located in flanges 46B and 46D, for connecting to tilt cylinder 40. Frame member 44 can be coupled to frame 18 in a stationary manner to provide support for lift arms 12A and 12B.

Cross member 14 can comprise couplers 16A and 16B, arm couplers 52A and 52B, torque tube 54, and tilt coupling 56. Lever 42 can comprise side bars 58A and 58B, and connectors 60A and 60B.

Tilt cylinder 40 can comprise piston rod 72 and cylinder housing 74. Lift cylinders 28A and 28B can comprise cylinder housings 77A and 77B, and piston rods 76A and 76B, respectively.

As discussed with reference to FIGS. 4 and 5, cylinder housing 74 can be coupled to coupler 50 to form pivot point 62, piston rod 72 can be coupled to side bars 58A and 58B to form pivot point 64, side bars 58A and 58B can be coupled to tilt coupling 56 to form pivot point 66, side bars 58A and 58B can be coupled to linkage 41 to form pivot point 68, and linkage 41 can be coupled to bucket to form pivot point 70.

As discussed with reference to FIGS. 4 and 6, eyelets 78A and 78B of lift arms 12A and 12B can be coupled to flanges 46A and 46B and 46C and 46D, respectively, to form pivot point 30, piston rods 76A and 76B can be coupled to couplers 16A and 16B via eyelets 80A and 80B, respectively, to form pivot point 32, eyelets 82A and 82B of side bars 58A and 58B can be coupled to eyelet 84 of tilt coupling 56 and apertures 86A and 86B of lift arms 12A and 12, respectively, to form pivot point 34, and eyelets 88A and 88B of lift arms 12A and 12B can be coupled to bucket 26 at flanges 90A and 90B to form pivot point 36. In other examples, apertures 86A and 86B can comprise clearance holes to provide access to eyelet 84 and do not form part of pivot point 34.

As such, lift arms 12A and 12B are can be coupled to various components of loader 10 in locations that improve the lifting ability of lift arm assembly 11, improve the robustness of lift arm assembly 11, and improve operator visibility. In particular, torque tube 54 and couplers 16A and 16B can be located in close proximity to each other, which is at least partially due to torque tube 54 and couplers 16A and 16B being fabricated from an integral, monolithic component, to lower couplers 16A and 16B relative to pivot point 30 and extend couplers 16A and 16B further away from pivot point 30, thereby improving operator visibility and the amount of torque that can be generated at pivot point 30 by lift cylinders 28A and 28B, respectively.

Figure 5:
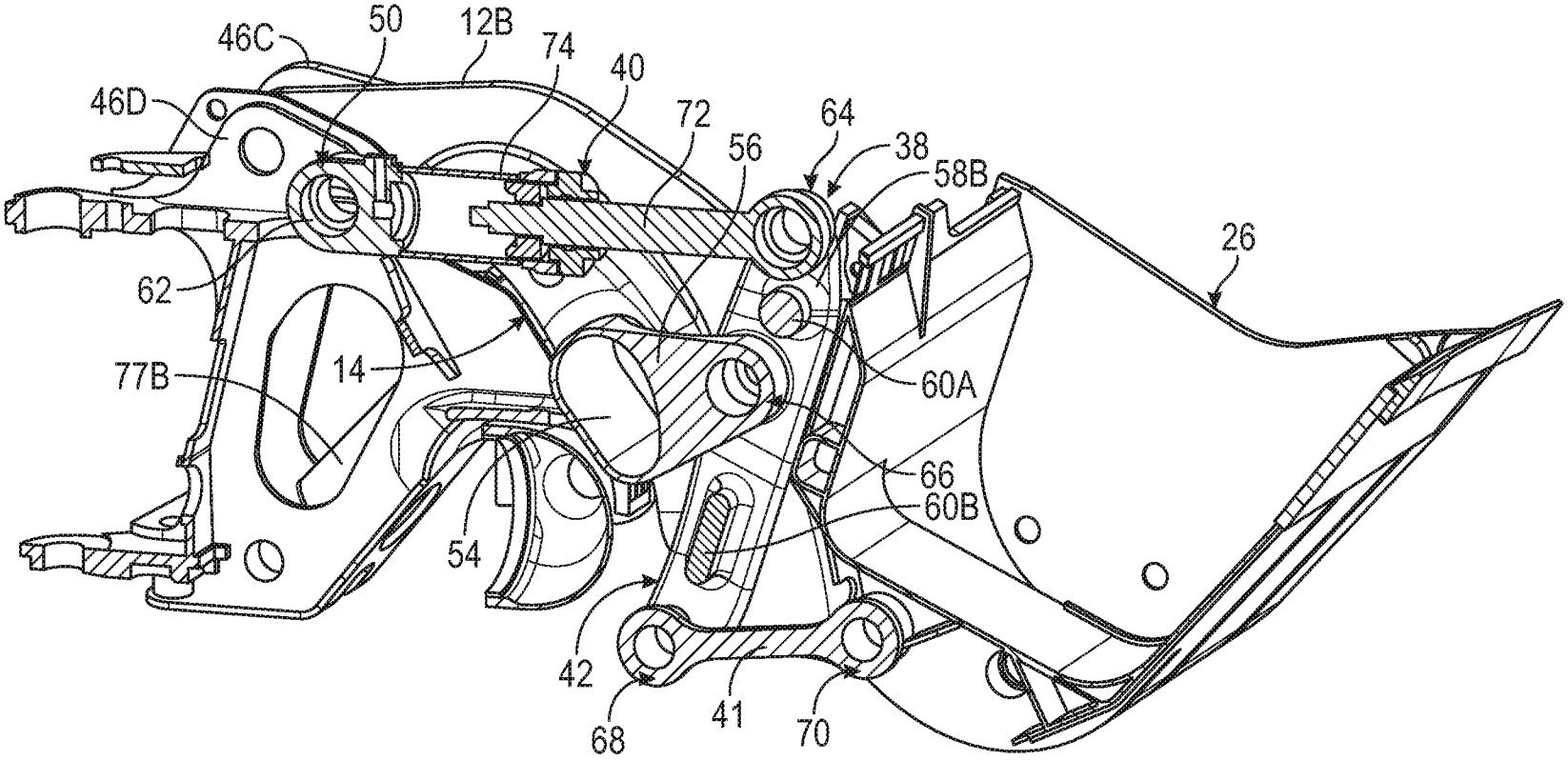
FIG. 5 is a first cross-sectional view of the lift arm assembly, bucket and frame member of FIG. 3 taken at a midline to extend through a tilt mechanism for the bucket.

FIG. 5 is a cross-sectional view of lift arm assembly 11, bucket 26 and frame member 44 of FIG. 4. The cross-section of FIG. 5 is taken along the center of lift arm assembly to show the connectivity of tilt mechanism 38. FIG. 6 is a side cross-sectional view of lift arm assembly 11, bucket 26 and frame member 44 of FIG. 4. The cross-section of FIG. 6 is taken along lift arm 12A to show the connectivity of lift cylinder 28A. FIGS. 4 and 5 are discussed together below to describe the interaction of tilt mechanism 38. FIGS. 4 and 6 are discussed together below to describe the interaction of lift arm assembly 11.

With reference to FIG. 5, tilt cylinder 40 can be coupled to flanges 46D and 46B at coupler 50 to form pivot point 62, such as through the use of a pin. Tilt cylinder 40 can extend to lever 42 to couple to side bars 58B and 58A at pivot point 64, such as through the use of a pin. Side bars 58A and 58B can connect to cross member 14 at tilt coupling 56 to form pivot point 66, such as through the use of a pin. Linkage 41 can extend from side bars 58A and 58B from pivot point 68 to pivot point 70, such as through the use of pins.

As such, bucket 26 can be tilted by actuation of tilt cylinder 40. For example, piston rod 72 can be extended from cylinder housing 74 (into the position shown in FIG. 5) to push against the top ends of side bars 58A and 58B, causing side bars 58A and 58B to pivot at pivot point 66. The top ends of side bars 58A and 58B can rotate at pivot point 64 and the bottom ends of side bars 58A and 58B can rotate at pivot point 68. Pivoting of side bars 58A and 58B at pivot point 66 also draws the bottom ends of side bars 58A and 58B toward frame member 44. As such, side bars 58A and 58B can rotate relative to piston rod 72 and linkage 41. Pivot points 62 and 66 can be maintained stationary, relative to frame member 44, by lift arms 12A and 12B being held in place by lift cylinders 28A and 28B, while pivot points 64, 68 and 70 are translated along linear or arcuate paths as tilt mechanism 38 operates. Movement of the bottom ends of side bars 58A and 58B towards frame member 44 also pulls linkage 41 toward frame member 44, thereby causing bucket 26 to pivot at pivot point 70 toward lift arms 12A and 12B.

Pivot points 62, 64, 66, 68 and 70 can comprise coupling locations for pivotably connecting tilt mechanism 38 to various components, such as through the use of pinned couplings. Tilt mechanism 38 is shown and described as being coupled via pins, but can be coupled by any suitable coupling means, such as couplers, pins, latches or any other mechanism generally known in the art. As described herein, pivot points 62, 64, 66, 68 and 70 can comprise holes or sockets located within the various components through which a pin can be extended to provide a rotatable or pivotable coupling.

Figure 6:
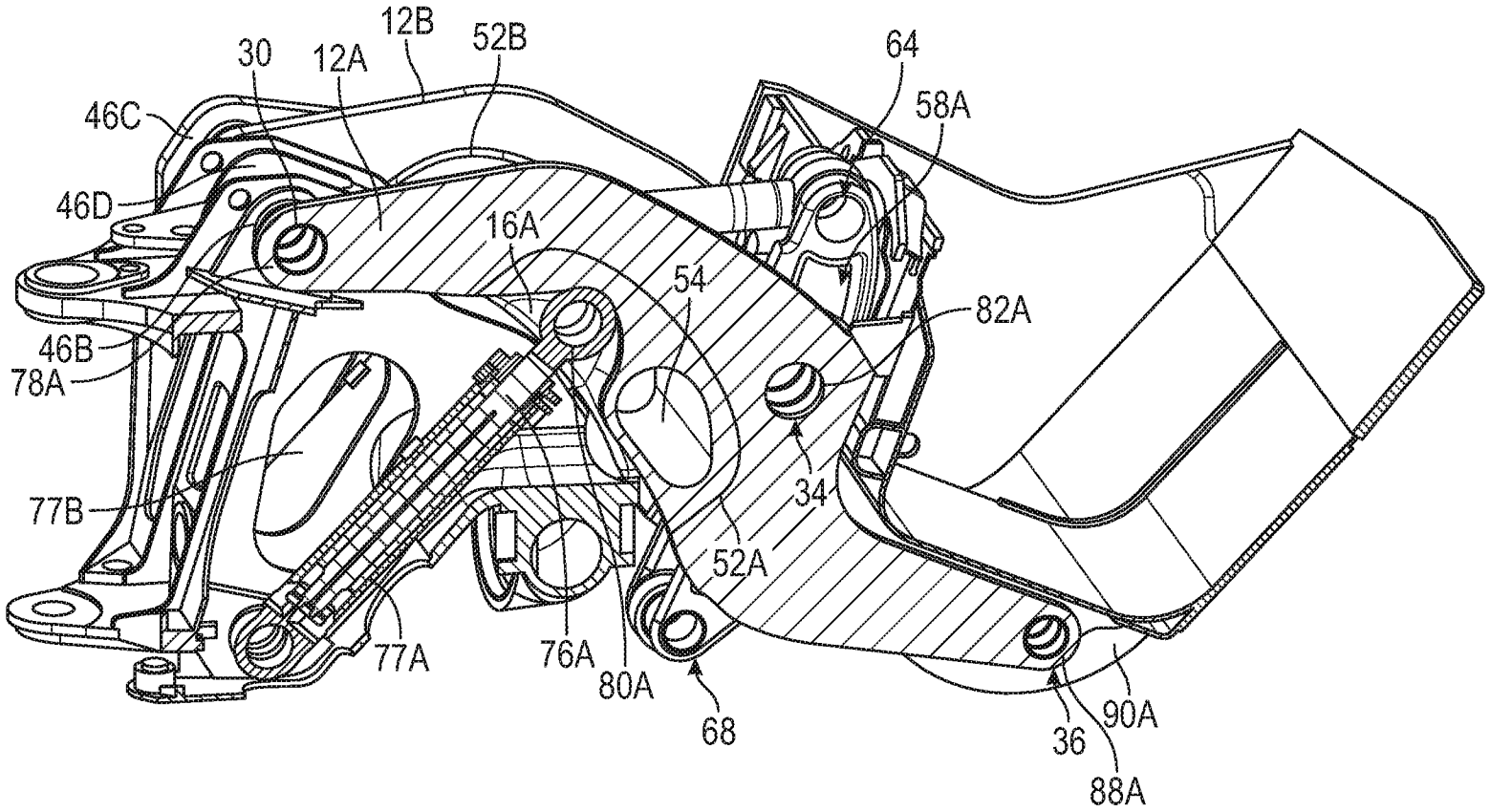
FIG. 6 is a second side cross-sectional view of the lift arm assembly, bucket and frame member of FIG. 4 taken to extend through a lift arm for the bucket.
Figure 7:
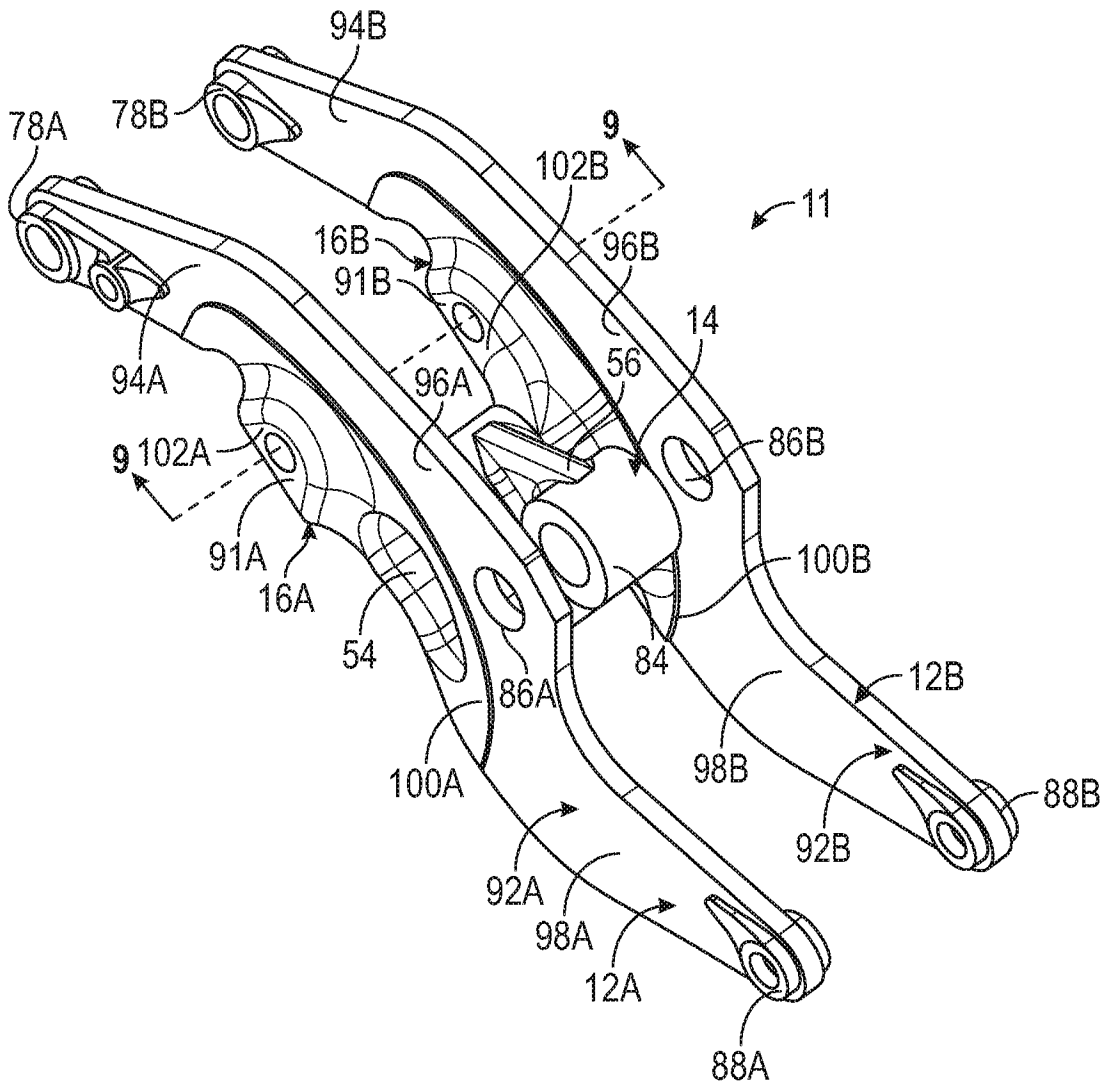
FIG. 7 is perspective view of the lift arm assembly of FIGS. 2-6.
Figure 9:
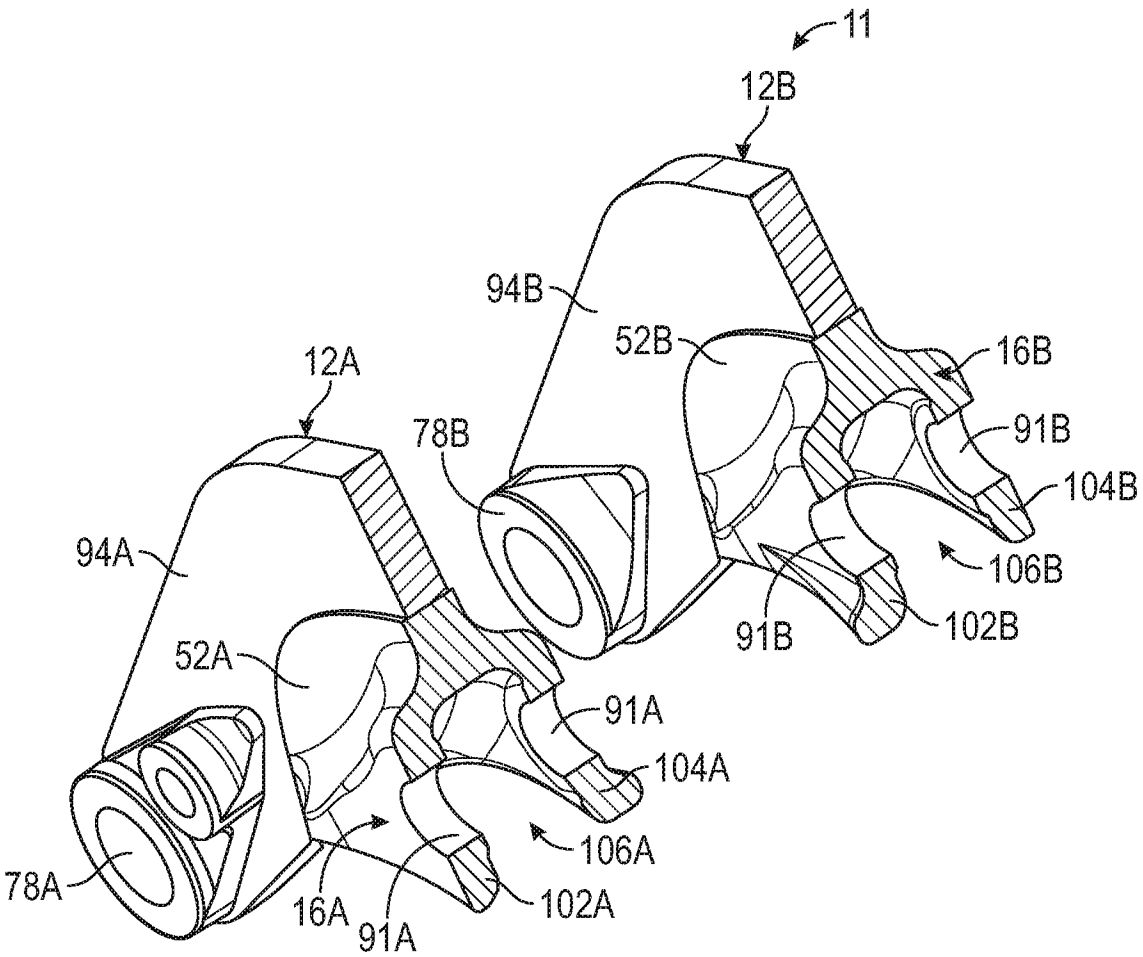
FIG. 9 is a cross-sectional view of the lift arm assembly taken at section 9-9 of FIG. 7 showing lift arm coupler pockets.

With reference to FIG. 6, bucket 26 can be lowered and raised by actuation of lift cylinders 28A and 28B. For example, piston rods 76A and 76B can be retracted into cylinder housings 77A and 77B (into the position shown in FIG. 6), respectively, to pull lift arms 12A and 12B toward frame member 44 by inducing pivoting at pivot point 30. Eyelets 80A and 80B can pivot within couplers 16A and 16B, respectively, at pivot point 32. Likewise, cylinder housings 77A and 77B can pivot at cylinder couplers 48A and 48B on frame member 44. Coupler 16A can comprise a double-walled pocket, as shown in FIG. 9, into which eyelet 80A can be positioned. As such, a pin can be extended through eyelet 80A and apertures 91A (FIG. 9) within coupler 16A. Coupler 16B and eyelet 80B can be configured in a like manner. Pivoting at pivot points 36 and 34 can be maintained stationary by tilting mechanism 38 being held in place by tilt cylinder 40 such that bucket 26 does not move relative to lift arms 12A and 12B. However, pivoting at pivot points 36 and 34 may occur when lift arms 12A and 12B are lifted even if tilt mechanism 38 remains stationary relative to itself.

Pivot points 30, 32, 34 and 36 can comprise coupling locations for pivotably connecting lift arms 12A and 12B to various components, such as through the use of pinned couplings. Lift arms 12A and 12B are shown and described as being coupled via pins, but can be coupled by any suitable coupling means, such as couplers, pins, latches or any other mechanism generally known in the art. As described herein, pivot points 30, 32, 34 and 36 can comprise holes or sockets located within the various components through which a pin can be extended to provide a rotatable or pivotable coupling.

As can be seen in FIG. 6, piston rod 76A can include eyelet 80A, rather than a clevis coupling. Coupler 16A forms pocket 106A (FIG. 9) that can receive eyelet 80A. Use of eyelet 80A can shorten the length of piston rod 76A as compared to use of a clevis coupling. Space saved by use of eyelet 80A can be used for placement of electronics within housing 77A and for lowering the location of pivot point 32 relative to pivot point 30 to improve operator visibility. Formation of pocket 106A is facilitated by forming cross member 14 as an integral, monolithic structure that can provide strength for the formation of sidewalls 102A-104B (FIG. 9) and can facilitate advantageous attachment, such as via a welding process, of cross member 14 to lift arms 12A and 12B. Piston rod 76A, eyelet 80A and coupler 16B can be similarly advantageously configured.

Figure 8:
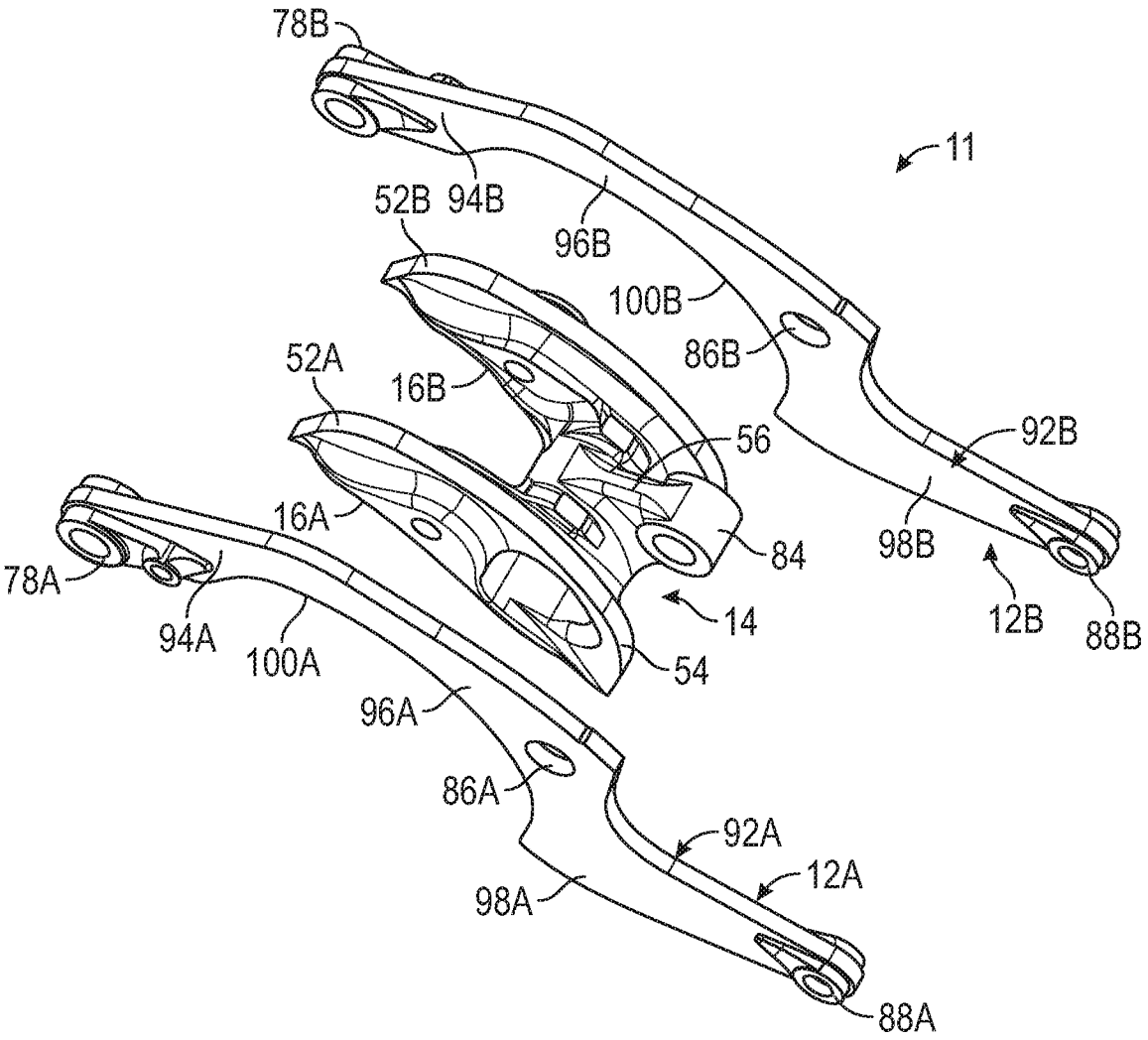
FIG. 8 is an exploded view of the lift arm assembly of FIG. 7.

FIG. 7 is perspective view of lift arm assembly 11 of FIGS. 2-6. FIG. 8 is an exploded view of lift arm assembly 11 of FIG. 7. FIG. 9 is a cross-sectional view of lift arm assembly 11 taken at section 9-9 of FIG. 7 showing lift arm coupler pockets 106A and 106B of cross member 14. FIGS. 7-9 8 are discussed concurrently. Lift arm assembly 11 can comprise lift arms 12A and 12B and cross member 14.

Lift arm 12A can comprise main body 92A including pivot end section 94A, hump section 96A and bucket end section 98A. Pivot end section 94A can include eyelet 78A, hump section 96A can include pocket 100A, and aperture 86A, and bucket end section 98A can comprise eyelet 88A. Lift arm 12B can comprise main body 92B including pivot end section 94B, hump section 96B and bucket end section 98B. Pivot end section 94B can include eyelet 78B, hump section 96B can include pocket 100B, and aperture 86B, and bucket end section 98B can comprise eyelet 88B.

Cross member 14 can comprise couplers 16A and 16B, arm couplers 52A and 52B, torque tube 54, tilt coupling 56 and eyelet 84. Coupler 16A can comprise sidewall 102A and 104A, between which is formed pocket 106A. Coupler 16B can comprise sidewall 102B and 104B, between which is formed pocket 106B.

Main body 92A can comprise a planar member into which eyelets 78A and 88A aperture 86A and pocket 100A can be formed. Hump section 96A can comprise a C-shaped or crescent-shaped body that forms pocket 100A. Pockets 100A can be shaped to receive arm coupler 52A. A such, main body 92A can be formed from a plate of material and cut to the desired shaped. Eyelets 78A and 88A can be reinforced such as with tubular sections. Main body 92B can be configured in a similar fashion as main body 92A.

Cross member 14 can be a unitary component having an H-shaped configuration, with arm couplers 52A and 52B forming legs of the H and torque tube 54 forming the connecting body. Torque tube 54 can comprise a walled body having an internal passage extending therethrough. Torque tube 54 can have a teardrop cross-sectional shape to, for example, resist twisting. In general a teardrop cross-sectional shaped as used herein can comprise oblong shapes having curved ends wherein one end has a larger radius of curvature than the other. Torque tube 54 can also have a "bean-shaped" cross-sectional profiles. Teardrop and bean shaped torque tubes can be resistant to twisting and also provide adequate strength to connect lift arms 12A and 12B. The wall of torque tube 54 can connect directly to arm couplers 52A and 52B at torque tube perimeter portions of 52A and 52B. Tilt coupling 56 can extend from torque tube 54 and coupled to eyelet 84. Couplers 16A and 16B can comprise sidewalls 102A and 104A and 102B and 104B, respectively. Walls can be spaced so that eyelet 80A and 80B can be disposed therein.

Cross member 14 can comprise a monolithic component wherein arm couplers 52A and 52B, torque tube 54, tilt coupling 56, eyelet 84 and sidewalls 102A and 104A are integrally connected. In an example, cross member 14 can be formed as a cast component that is machined to size and include features such as apertures 91A.

Arm couplers 52A and 52B can be coupled to pockets 100A and 100B, respectively, such via a welding process. As such, torque tube 54 can provide a rigid lateral or side-to-side coupling for lift arms 12A and 12B. Welding can improve life of torque tube 54, such as versus torque tubes that were previously welded directly to lift arms, such as by locating the weld seam away from stress points on torque tube 54. Additionally, couplers 16A and 16B can be positioned close to torque tube 54 due to, for example, the integral or monolithic construction of cross member 14. In an example, portion of the wall of torque tube 54 can form portions of couplers 16A and 16B. Also, the integral or monolith construction of cross member 14 permits sidewalls 102A-104B to be strong enough to support coupling to lift cylinders 28A and 28B at an eyelet configuration, rather than with a clevis configuration where a single hole would be provided in a lift arm and a U-shaped coupler on a hydraulic piston shaft having two holes therein would be coupled to the outside of the lift arm. Couplers 16A and 16B facilitate the use of eyelets 80A and 80B, which allow the axis of pivot point 32 to be brought closer to cylinder housing 74 when piston rod 72 is fully retracted, as compared to a clevis embodiment. In other words, use of eyelets 80A and 80B reduce the amount of "dead length" within housing 77A and 77B, which is particularly important for incorporating in-cylinder sensing. As such, the overall length of lift cylinders 28A and 28B can be shortened, which facilitates reducing the height of hump sections 96A and 96B relative to pivot point 30 thereby improving operator visibility.

Figure 10:
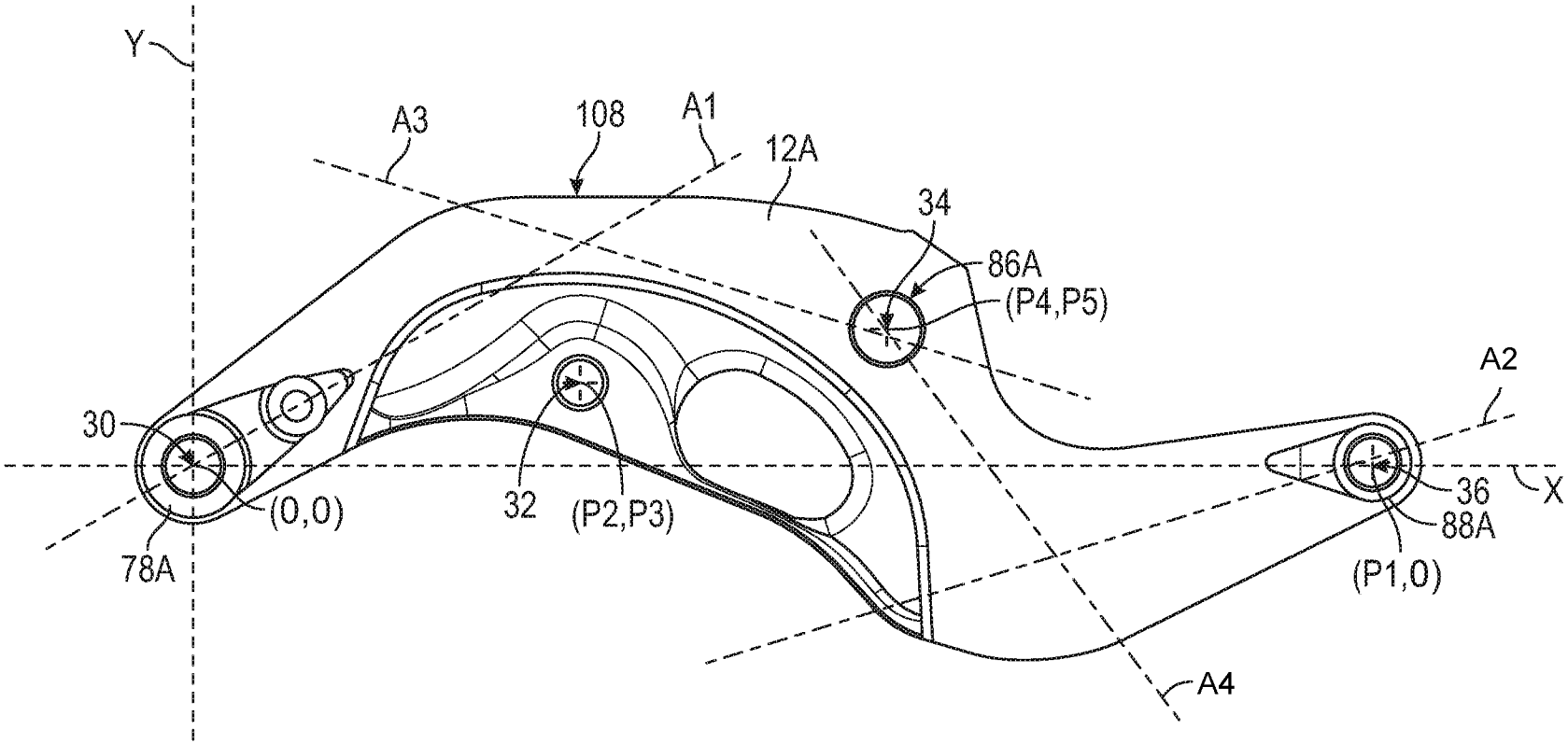
FIG. 10 is a side view of the lift arm assembly of FIG. 9 showing a coordinate system for the location of pivot points.

FIG. 10 is a side view of lift arm 12A of FIG. 7 showing a coordinate system for the location of pin locations including an X-axis and a Y-axis. Pivot end section 94A can extend in a generally linear fashion along axis A1, bucket end section 98A can extend in a generally linear fashion along axis A2, and hump section 96A can extend in a curved or segmented fashion generally along axes A3 and A4.

Pivot end section 94A and bucket end section 98A provide length to lift arm 12A in order to distance pivot point 36 away from pivot point 30. As such, lift arm 12A can provide clearance of moving bucket 26 out beyond the front end of loader 10 and front traction devices 20.

Pivot point 34 can be located at a location suitable for providing side bars 58A and 58B suitable leverage for tilting bucket 26. For example, it can be desirable for pivot point 34 to be close to the X-axis to improve operator visibility, but above pivot point 36 to allow tilt cylinder 40 to apply torque to pivot point 36.

Pivot point 32 can be located close to the X-axis to reduce the height of hump section 96A, thereby improving operator visibility. Furthermore, pivot point 32 can be located away from pivot point 30 to assist lift cylinders 28A and 28B in generating adequate torque at pivot point 30. In order to extend the distance that pivot point 32 is located from pivot point 30, pivot point 32 can be incorporated into cross member 14. Cross member 14 can be fabricated as a single-piece component separate from lift arms 12A and 12B. As such, pivot point 32 can be located in close proximity to torque tube 54 without compromising integrity of torque tube 54 or couplers 16A and 16B.

Pivot point 30 can be located at the origin of the coordinate system, at point (0.0) on the X-axis and Y-axis. Pivot point 36 can be located on the X-axis some distance from the Y-axis, at point (P1,0) on the X-axis and Y-axis. Pivot point 32 can be located some distances from the X-axis and the Y-axis at point (P2, P3) on the X-axis and Y-axis. Pivot point 34 can be located some distances from the X-axis and the Y-axis at point (P4, P5) on the X-axis and Y-axis.

In an example, pivot point 32 can be located approximately one-third of the distance between pivot points 30 and 36 from pivot point 30. In an example, pivot point 34 can be located approximately two-thirds of the distance between pivot points 30 and 36 from pivot point 30.

In an example, coordinates P2 and P3 for pivot point 32 can be approximately 1.142 and 0.241 units of measure, respectively from the origin. In configurations where through bore 89 is presented in combination with omitting coupler 16A, such as is shown in FIG. 4, coordinates P2 and P3 can be approximately 1.138 and 0.152. In an example, coordinates P4 and P5 for pivot point 34 can be approximately 2.050 and 0.400 units of measure, respectively from the origin. In an example, coordinate P1 for pivot point 36 can be approximately 3.483 units of measure, respectively from the origin.

In the present application, a unit of measure can be a meter. The present inventors have found that the specific locations for the various pivot points described herein achieve the benefits for the specific embodiment described herein. Depending on specific embodiments and design needs, the exact locations of the pivot points described herein, such as coordinates P1-P5, can be moved to meet specific design needs. The present inventors have found that points described herein, such as coordinates P1-P5, can be moved within a tolerance radius of 0.14 units of measure, e.g. 140 mm, in order to maintain desired lifting capabilities, turn radii, stress limitations, safety considerations and the like. More particularly, coordinates P1-P5, can be moved within a tolerance radius of 0.1 units of measure, e.g. 100 mm, in order to maintain desired lifting capabilities, turn radii, stress limitations, safety considerations and the like. Likewise, the assemblies and components described herein, such as lift arms 12A and 12B, can be scaled-up or scaled down to different sizes while maintaining the same proportions to achieve desirable performance characteristics.

Figure 11:
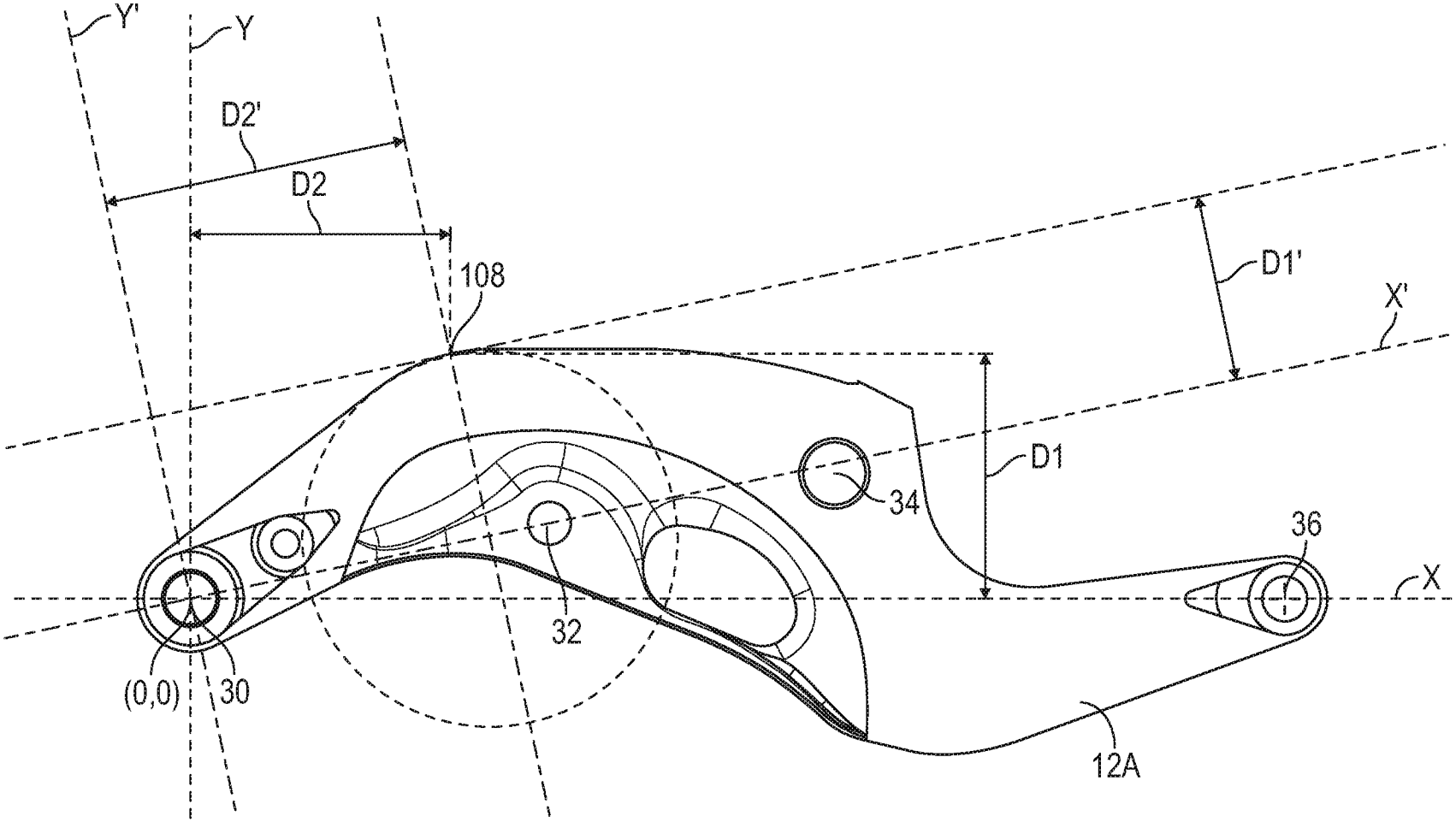
FIG. 11 is a side view of the lift arm assembly of FIG. 9 showing an alternative coordinate system for the location of features of the lift arms.

FIG. 11 is a side view of lift arm assembly 11 of FIG. 7 showing an alternative coordinate system for the location of pin locations including an X'-axis and a Y'-axis. The X'-axis and the Y'-axis can be useful in describing the position of peak 108 of the hump of hump sections 96A and 96B. Peak 108 can represent the high-point of lift arms 12A and 12B when lift arms 12A and 12B are in a lowered position, such as when an operator of loader 10 would be driving loader 10. In an example, peak 108 can be located a distance D1 from the X'-axis and a distance D2 from the Y'-axis.

In an example, D1' and D2' can comprise 0.977 and 0.591 units of measure relative to the X'-axis and the Y'-axis. For comparison, in such example, D1 and D2 can comprise 0.834 and 0.780 units of measure relative to the X-axis and the Y-axis, e.g., D1 and D2 can comprise 0.834 and 0.780 units of measure.

INDUSTRIAL APPLICABILITY

The present disclosure describes various systems, assemblies, devices and methods for constructing and operating lift arm assemblies, such as for use with loaders including underground wheel loaders.

The shape and dimensions of lift arms 12A and 12B can be determined to allow for placement of pivot point 32 for lift cylinders 28A and 28B. In particular, the distance of pivot point 32 from pivot point 30 can be increased, as compared to lift arms not having couplers 16A and 16B integrated into cross member 14 with an integrated torque tube 54. Such placement additionally reduces the height of peak 108 to increase operator visibility while at the same time providing increased torsional rigidity and improved strength with the capability to withstand higher stress, e.g., greater breakout force.

Incorporation of torque tube 54 and couplers 16A and 16B into cross member 14 additionally facilitates the use of in-cylinder sensing by providing additional length in the hydraulic cylinder housing to reduce "dead length, thereby freeing space for sensors, such as electronic position sensors for piston rods 76A and 76B. In other configurations, in-cylinder sensors can be replaced with external sensors, such as rotary sensors, to, among other things, achieve more beneficial breakout forces and to facilitate use of clevis couplers on lift cylinders rather than lift cylinders using eyelets.

What is claimed is:

1. A lift arm for a loader, the lift arm comprising:

a pivot end section extending along a first axis and including a first pin hole defining an origin at the intersection of a horizontal x-axis and a vertical y-axis;

a bucket end section extending along a second axis and including a second pin hole located a first distance away from the origin along a horizontal direction, the horizontal direction being parallel to the x-axis; and a hump section connecting the pivot end section and the bucket end section, the hump section comprising:

a lifting cylinder coupler section including a third pin hole located a second distance away from the origin along the horizontal direction, a ratio of the second distance divided by the first distance being not less than 0.277 and not greater than 0.383; and a torque tube coupling section.

2. The lift arm of claim 1, wherein the lifting cylinder coupler section comprises a pocket;

the lifting cylinder coupler section is adjacent to the torque tube coupling section; and the hump section curves around one side of the lifting cylinder coupler section and the torque tube coupling section.

3. The lift arm of claim 2, wherein the lifting cylinder coupler section and the torque tube coupling section comprise a monolithic component attached to the hump section.

4. The lift arm of claim 2, wherein the pocket comprises:

a first sidewall bulging out from a first side of the lift arm;

a second sidewall bulging out from a second side of the lift arm;

a space between the first sidewall and the second sidewall; and a pair of pin holes extending through the first and second sidewalls.

5. The lift arm of claim 1, wherein the hump section further comprises a fourth pin hole disposed between the second pin hole and the third pin hole along the horizontal direction, the fourth pin hole being located a third distance away from the origin along the horizontal direction, a ratio of the third distance divided by the first distance is not less than 0.527 and not greater than 0.655.

6. The lift arm of claim 5, further comprising:

a frame of the loader pivotally coupled to the pivot end section via a first pin disposed in the first pin hole;

a bucket pivotally coupled to the bucket end section via a second pin disposed in the second pin hole;

a lifting cylinder pivotally coupled to the hump section via a third pin disposed in the third pin hole; and a tilting mechanism pivotally coupled to the hump section via a fourth pin disposed in the fourth pin hole.

7. The lift arm of claim 5, wherein a ratio of the third distance divided by the first distance is not less than 0.544 and not greater than 0.636.

8. The lift arm of claim 1, wherein the hump section further comprises a peak located a third distance from the origin along a vertical direction, the vertical direction being parallel to the y-axis, an alternative axis is defined between the first pin hole and the third pin hole, the peak is a point of the hump section that is located furthest from the alternative axis along a direction perpendicular to the alternative axis, the peak is located closer to the origin than the third pin hole, the third pin hole is located a fourth distance away from the origin along the vertical direction that is approximately one-third of the third distance.

9. The lift arm of claim 1, wherein:

the pivot end section extends from the origin along the first axis above the x-axis;

the bucket end section extends from the second pin hole along the second axis below the x-axis; and the torque tube coupling section intersects the x-axis.

10. The lift arm of claim 1, further comprising:

a frame of the loader pivotally coupled to the pivot end section via a first pin disposed in the first pin hole;

a bucket pivotally coupled to the bucket end section via a second pin disposed in the second pin hole; and a lifting cylinder pivotally coupled to the hump section via a third pin disposed in the third pin hole.

11. The lift arm of claim 1, wherein a ratio of the second distance divided by the first distance is not less than 0.291 and not greater than 0.367.

12. A lift arm for a loader, the lift arm comprising:

a pivot end section extending along a first axis and including a first pin hole defining an origin at the intersection of a horizontal x-axis and a vertical y-axis;

a bucket end section extending along a second axis and including a second pin hole located a first distance away from the origin along a horizontal direction, the horizontal direction being parallel to the x-axis; and a hump section connecting the pivot end section and the bucket end section, the hump section comprising:

a lifting cylinder coupler section including a third pin hole located a second distance away from the origin along the horizontal direction, a ratio of the second distance divided by the first distance being not less than 0.277 and not greater than 0.383, and a pocket; and a torque tube coupling section, wherein the pocket comprises:

a first sidewall bulging out from a first side of the lift arm;

a second sidewall bulging out from a second side of the lift arm;

a space between the first sidewall and the second sidewall; and a pair of pin holes extending through the first and second sidewalls.

13. The lift arm of claim 12, wherein the lifting cylinder coupler section is adjacent to the torque tube coupling section; and the hump section curves around one side of the lifting cylinder coupler section and the torque tube coupling section.

14. The lift arm of claim 13, wherein the lifting cylinder coupler section and the torque tube coupling section comprise a monolithic component attached to the hump section.

15. The lift arm of claim 13, wherein the hump section defines a peak located a third distance from the origin along a vertical direction, the vertical direction being parallel to the y-axis, an alternative axis is defined between the first pin hole and the third pin hole, the peak is a point of the hump section that is located furthest from the alternative axis along a direction perpendicular to the alternative axis, and the peak is located closer to the origin than the third pin hole.

16. The lift arm of claim 12, further comprising:

a frame of the loader pivotally coupled to the pivot end section via a first pin disposed in the first pin hole;

a bucket pivotally coupled to the bucket end section via a second pin disposed in the second pin hole; and a lifting cylinder pivotally coupled to the hump section via a third pin disposed in the third pin hole.

17. The lift arm of claim 12, wherein a ratio of the second distance divided by the first distance is not less than 0.291 and not greater than 0.367.

* * * * *